US006386366B1

(12) United States Patent
Friedman

(10) Patent No.: US 6,386,366 B1
(45) Date of Patent: May 14, 2002

(54) SHIPPING AND DISPLAY CONTAINER

(75) Inventor: Davide R Friedman, Prior Lake, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/589,940

(22) Filed: Jun. 7, 2000

(51) Int. Cl.[7] ..... B65D 5/50; B65D 85/00

(52) U.S. Cl. ..... 206/526; 206/45.3; 206/774

(58) Field of Search ..... 206/740, 744, 206/745, 751–765, 526, 45.3, 774; 229/235, 240, 123.2

(56) References Cited

U.S. PATENT DOCUMENTS

| | | | | | |
|---|---|---|---|---|---|
| 2,078,018 | A | * | 4/1937 | Powell | 206/756 |
| 2,178,091 | A | * | 10/1939 | Weiss | 206/45.3 |
| 2,260,428 | A | * | 10/1941 | Barr et al. | 206/760 |
| 2,263,524 | A | * | 11/1941 | Steinbiss | 206/45.3 |
| 3,659,707 | A | * | 5/1972 | Nilsson et al. | 206/561 |
| 3,786,914 | A | * | 1/1974 | Beutler | 206/767 |
| 3,955,671 | A | * | 5/1976 | Ockey | 206/562 |
| 4,058,206 | A | * | 11/1977 | Morse et al. | 229/240 |
| 4,448,303 | A | * | 5/1984 | Beckenfeld | 206/763 |
| 4,650,075 | A | * | 3/1987 | Grazia | 206/526 |
| 4,705,162 | A | * | 11/1987 | Kupersmit | 206/745 |
| 5,447,269 | A | | 9/1995 | Fultz | |
| 5,871,095 | A | | 2/1999 | Warnock et al. | |
| 5,896,995 | A | | 4/1999 | Murray et al. | |
| 5,900,264 | A | | 5/1999 | Gics | |
| 5,901,841 | A | | 5/1999 | Lusker | |
| 5,921,398 | A | | 7/1999 | Carroll | |

OTHER PUBLICATIONS

Tops Engineering Corporation, User's Guide (Version 1.0+, Total Optimization Packaging Software), ©1994.

Fibre Box Association, Fibre Box Handbook, ©1999, pp. 10–11, 18–32, 34–37, 42, 44–50, 68–70, and 81–85.

* cited by examiner

*Primary Examiner*—Bryon P. Gehman

(74) *Attorney, Agent, or Firm*—John A. O'Toole; Douglas J. Taylor; Timothy A. Czaja

(57) ABSTRACT

A shipping and display container includes a tray and a cover. The tray includes a bottom panel, a back panel extending upward from the bottom panel, and a front panel also extending upward from the bottom panel. The back panel extends upward beyond the front panel and a pair of bottom side flaps each extending upward from opposite sides of the bottom panel. The cover includes a top panel and a front panel extending downward from the top panel. The cover is positionable over the tray to establish a first configuration facilitating shipping and storage of the container and is removable from the tray to establish a second configuration facilitating support and upright display of a packaged product positioned on the tray.

38 Claims, 11 Drawing Sheets

SHIPPING AND DISPLAY CONTAINER

BACKGROUND OF THE INVENTION

The present invention relates generally to a container for shipping and storage as well as support and upright display of a packaged product, especially a packaged food product. More particularly, the present invention relates to a container which, in a first configuration, facilitates shipping and storage of a packaged product positioned within the container and, in a second configuration, facilitates support and upright display of the packaged product for consumer purchase.

Containers, including paperboard cartons or boxes, have been used for many years to transport and store individually packaged products including, for example, packaged food products such as cereals, snack foods, dried fruit products, etc. Several individually packaged products are generally packed within a single paperboard box which is provided with a removable lid or an integral folded top which is sealed. The packaged products are generally transported within the closed or sealed box from a manufacturing facility to a place of retail sale. In order to present the packaged products for retail sale, store personnel must first remove the lid or open the sealed top, remove each individually packaged product from the box, properly position each individually packaged product on available display shelves, and finally discard the box. Thus, transporting packaged products from a manufacturing facility to a storage location and then to a display location using conventional paperboard cartons or boxes is a labor-intensive process. Furthermore, closed or sealed boxes, unless labeled or printed externally, prevent retailers from determining what is packaged therein.

Shown in FIGS. 1 and 2, is a container 1 which is currently used to transport and store several individually packaged products P. The container 1 includes a body 2 having a bottom panel 3 and two side panels 4 extending upward from opposite sides of the bottom panel 3. Openings 5 are provided in opposite sides of the body 2 and permit limited viewing of one face of the packaged products P. The container 1 also includes a removable lid 6. In order to display the packaged products P loaded within the container 1, the lid 6 must first be removed. Thereafter, each individually packaged product P must be removed from the body 2 and properly positioned in a display location. This, however, is a labor-intensive process, as previously described.

Alternatively, after the lid 6 is removed, the body 2, with the packaged products P loaded therein, can be positioned in a display location. In order to permit access to the packaged products P by a consumer, a bottom flap 7 and side flaps 8 of the body 2 must also be opened. In this state, however, the body 2, as shown in FIG. 2, appears unkempt and only permits limited viewing of one face of the packaged products P. In addition, when the bottom flap 7 and the side flaps 8 are opened, the body 2 no longer provides adequate support for the packaged products P. For example, if the packaged products P are packaged as individual bags or soft-side packages, the side flaps 8 and, especially, the bottom flap 7 no longer provide vertical or lateral support for the packaged products P. The packaged products P, therefore, can easily fall through one of the openings 5. Consequently, positioning of the body 2 in a display location, with the packaged products P loaded therein, results in a product display which is generally unappealing and unattractive to a consumer.

Accordingly, a need exists for a container which facilitates shipping and storage of a packaged product as well as support and upright display of the packaged product for consumer purchase.

SUMMARY OF THE INVENTION

One aspect of the present invention provides a container including a tray and a cover. The tray includes a bottom panel, a back panel extending upward from the bottom panel, and a front panel also extending upward from the bottom panel. The back panel extends upward beyond both the front panel and a pair of bottom side flaps each extending upward from opposite sides of the bottom panel. The cover includes a top panel and a front panel extending downward from the top panel. As such, the cover is positionable over the tray to establish a first configuration facilitating shipping and storage of the container and is removable from the tray to establish a second configuration facilitating support and upright display of a packaged product adapted to be positioned on the tray.

Another aspect of the present invention provides a packaged good article including a shipping and display container and a plurality of packaged products positioned within the shipping and display container. The shipping and display container includes a tray and a cover. The tray includes a bottom panel, a back panel extending upward from the bottom panel, and a front panel also extending upward from the bottom panel. The back panel extends upward beyond both the front panel and a pair of bottom side flaps each extending upward from opposite sides of the bottom panel. The cover includes a top panel and a front panel extending downward from the top panel. As such, the cover is positionable over the tray to establish a first configuration facilitating shipping and storage of the packaged products and is removable from the tray to establish a second configuration facilitating support and upright display of the packaged products. In one preferred embodiment, the packaged products are packaged food products, such as cereals, snack foods, dried fruit products, etc.

Another aspect of the present invention provides a blank for forming a tray of a shipping and display container. The blank includes a bottom panel, a back panel adjacent to the bottom panel, a front panel adjacent to the bottom panel opposite the back panel, and a pair of bottom side flaps each extending from opposite sides of the bottom panel. The front panel has a dimension extending perpendicular to a front edge of the bottom panel and each of the bottom side flaps have a dimension extending perpendicular to a side edge of the bottom panel. In addition, the back panel has a dimension extending perpendicular to a back edge of the bottom panel such that the dimension of the back panel is greater than both the dimension of the front panel and the dimension of the bottom side flaps.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
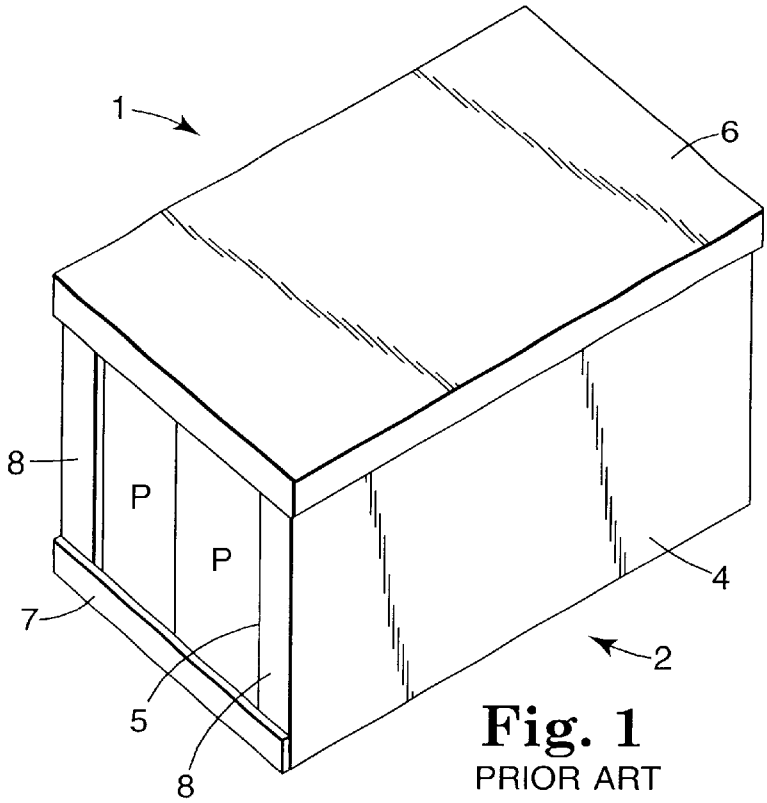
Fig. 1 PRIOR ART
FIG. 1 is a perspective view of a prior art container loaded with a plurality of packaged products.
Figure 2:
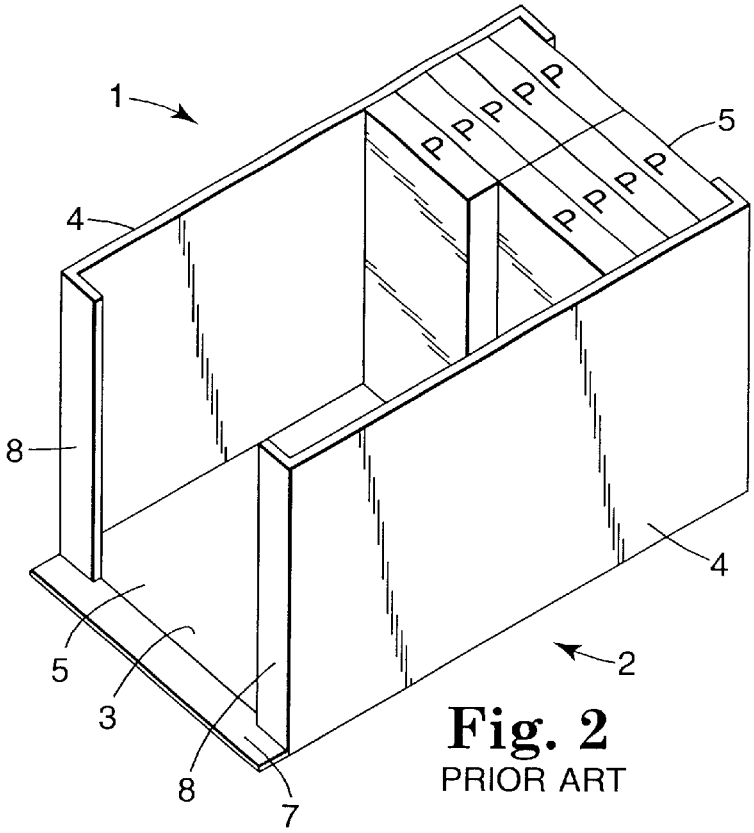
Fig. 2 PRIOR ART
FIG. 2 is a perspective view of the prior art container of FIG. 1 with the cover removed and the bottom and side flaps opened.
Figure 3A:
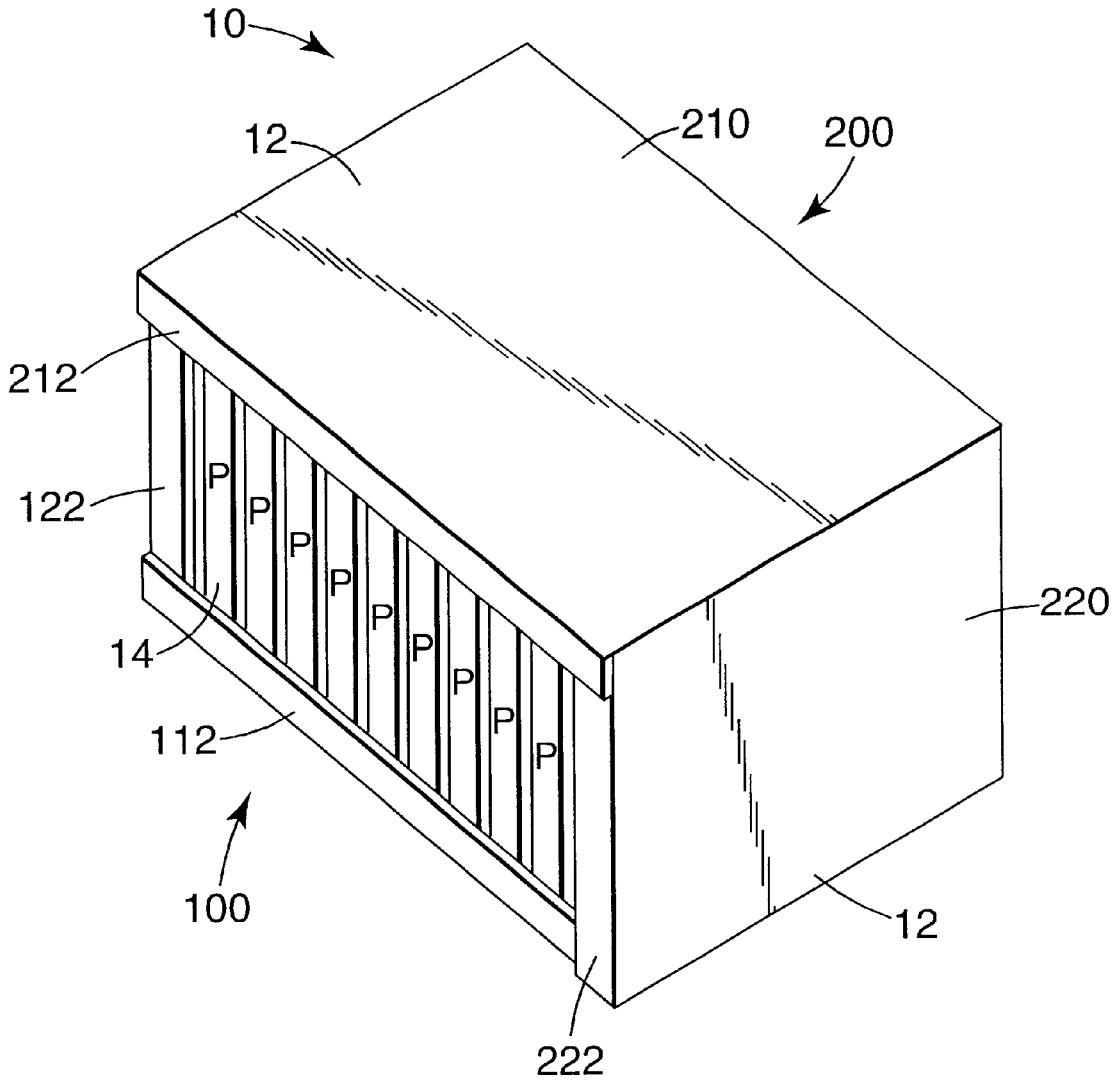
FIG. 3A is a front perspective view of a shipping and display container according to the present invention loaded with a plurality of packaged products in a shipping and storage configuration.
Figure 3B:
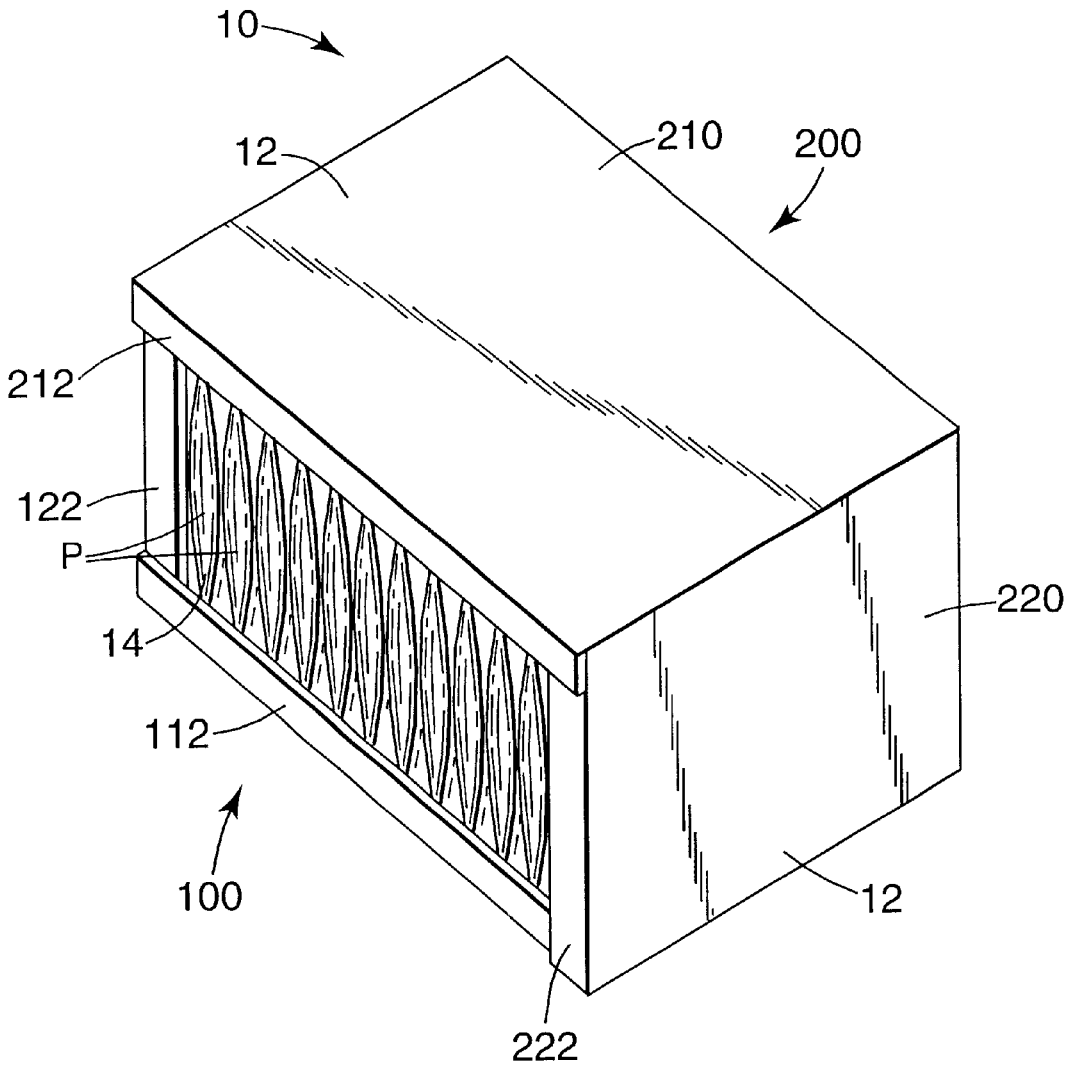
FIG. 3B is a front perspective view of a shipping and display container according to the present invention loaded with a plurality of packaged products in a shipping and storage configuration.

In FIGS. 3A and 3B, one preferred embodiment of a shipping and display container 10 is shown. The shipping and display container 10 includes a tray 100 and a cover 200. A plurality of packaged products P are positioned on the tray 100 and contained within the shipping and display container 10. FIG. 3A shows the plurality of packaged products P as being packaged as individual, relatively rigid boxes or cartons. FIG. 3B, however, shows the plurality of packaged products P as being packaged as individual bags or soft-side packages.

Figure 4A:
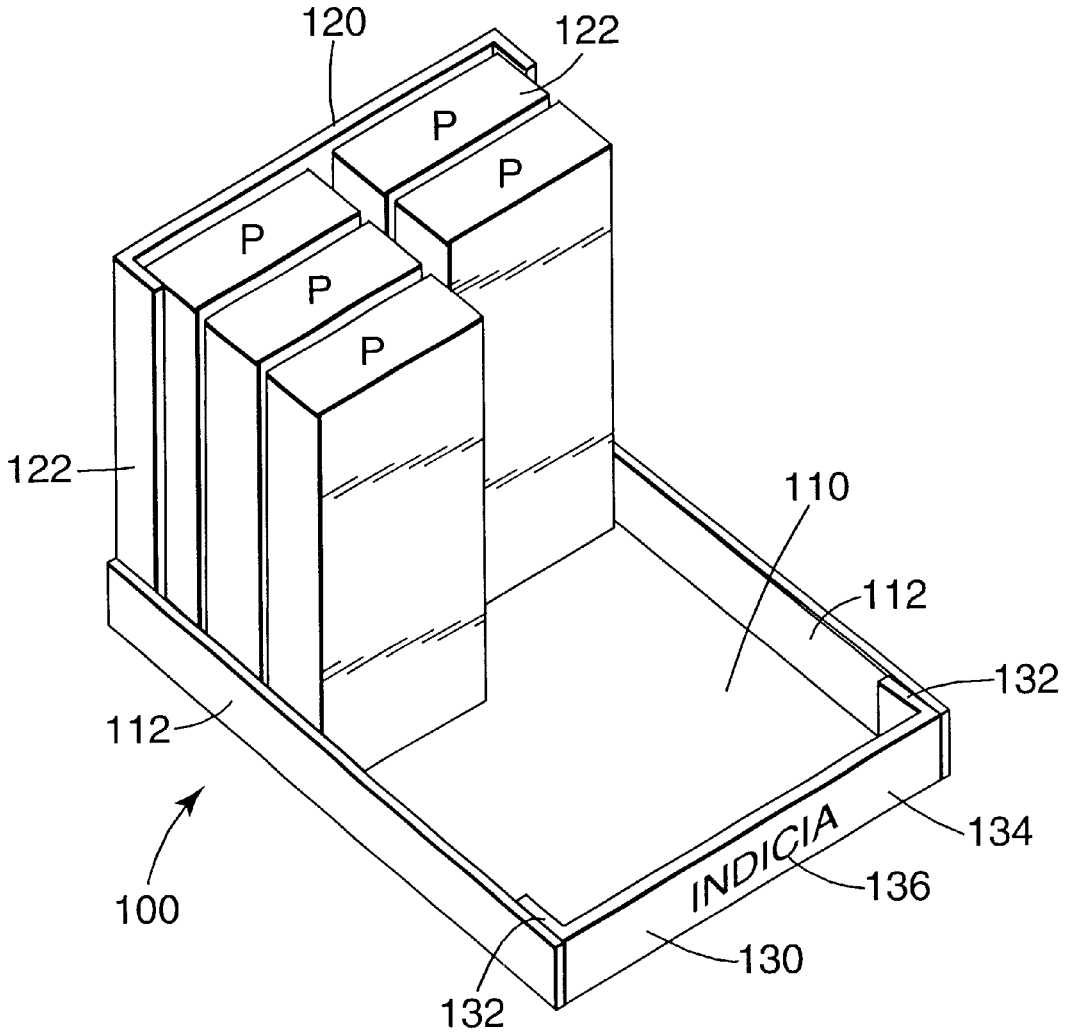
FIG. 4A is a front perspective view of the shipping and display container of FIG. 3A with the cover removed to establish a support and display configuration.
Figure 4B:
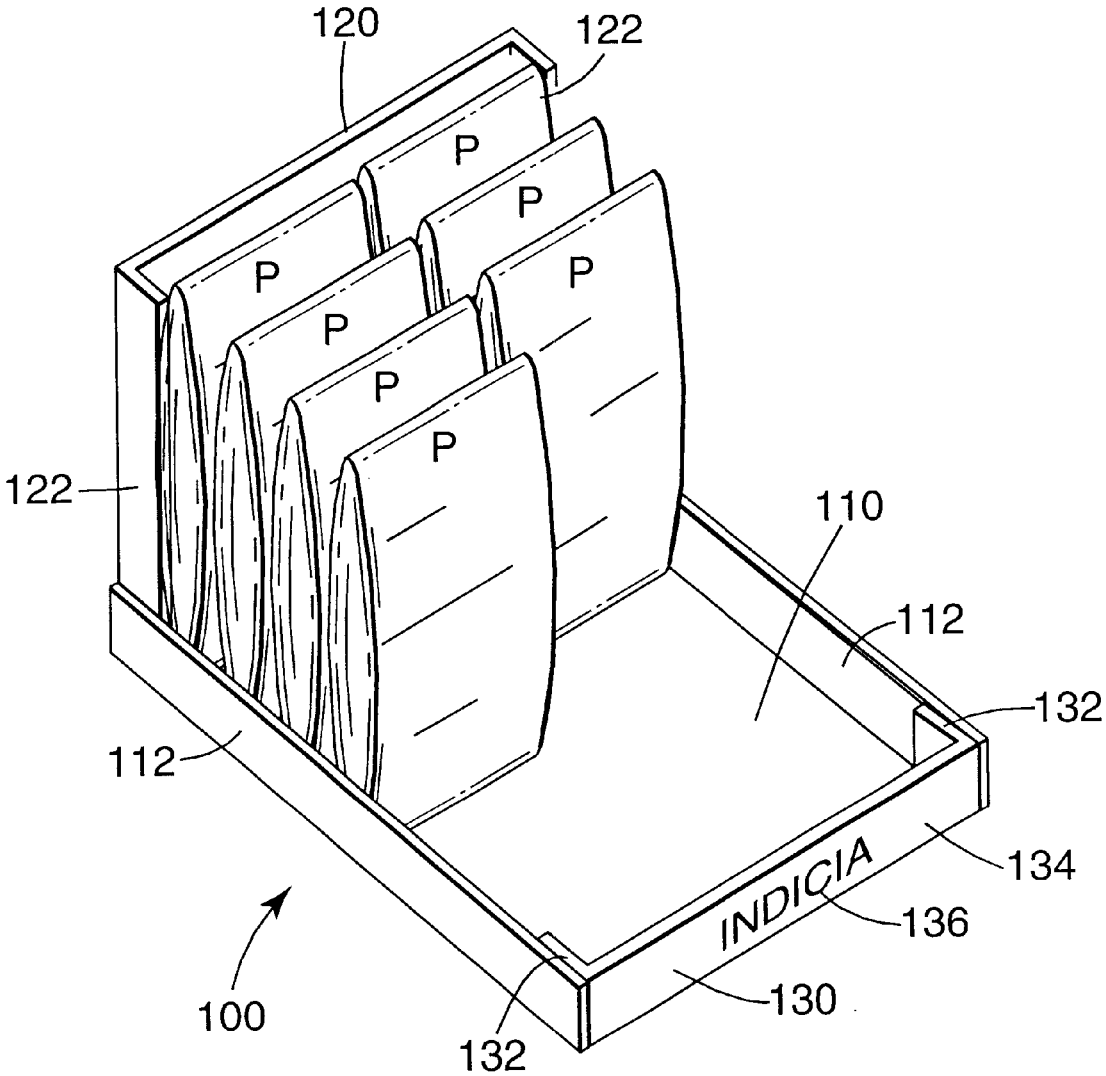
FIG. 4B is a front perspective view of the shipping and display container of FIG. 3B with the cover removed to establish a support and display configuration.

Positioning and securing the cover 200 over and to the tray 100 establishes a first or shipping and storage configuration of the shipping and display container 10, as shown in FIGS. 3A and 3B. In the shipping and storage configuration, the tray 100 and the cover 200 preferably create a generally rectangular container with four generally closed sides 12 (only two of which being shown) and two partially opened opposite sides 14 (only one of which being shown). Removing the cover 200 from the tray 100 establishes a second or support and display configuration of the shipping and display container 10 of FIGS. 3A and 3B, as shown in FIGS. 4A and 4B, respectively.

Figure 5:
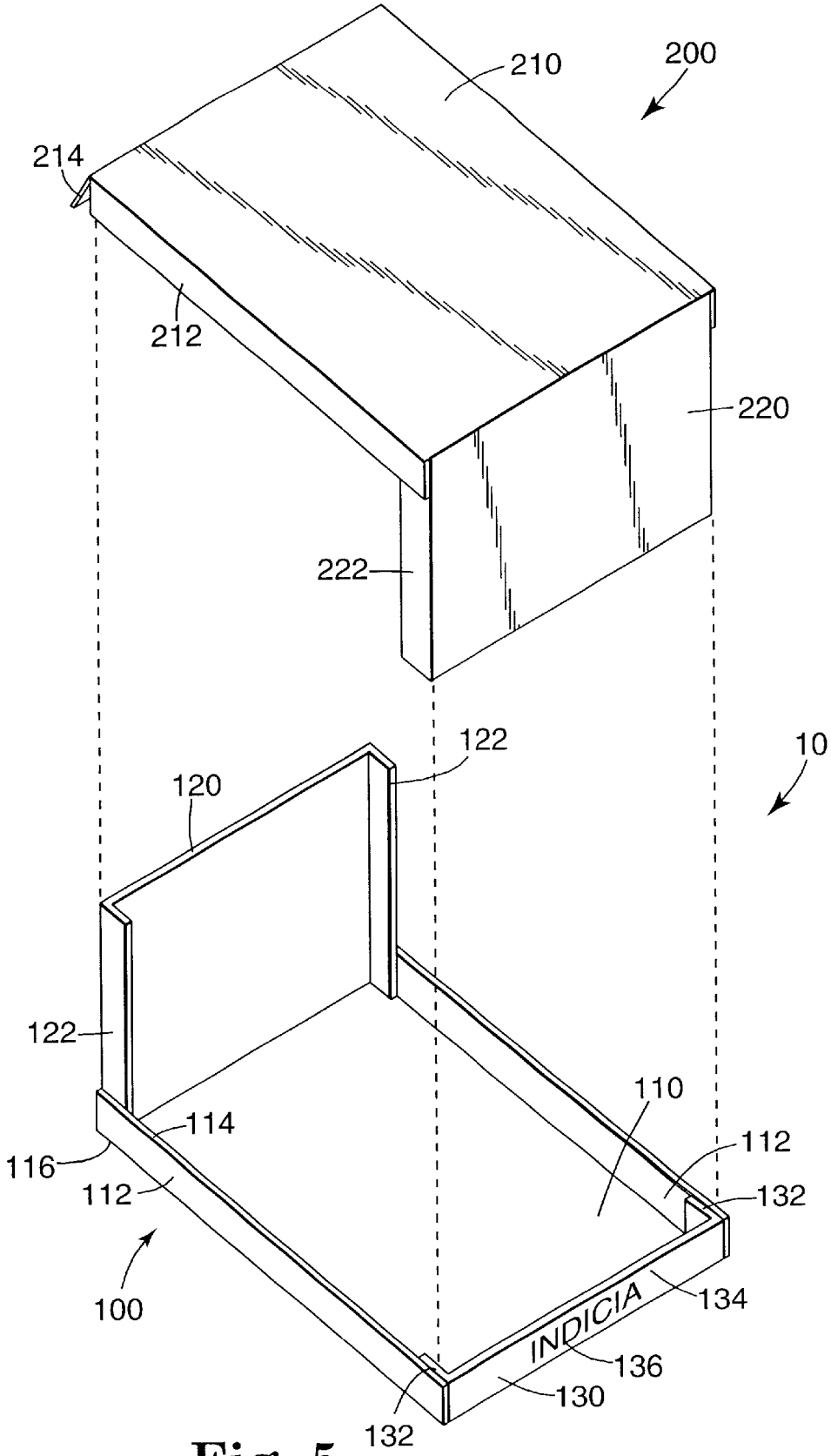
FIG. 5 is an exploded front perspective view of one embodiment of a shipping and display container according to the present invention.

One embodiment of the shipping and display container 10, is shown in FIG. 5. As shown in FIG. 5, the tray 100 of the shipping and display container 10 includes a bottom panel 110, a back panel 120 extending upward from the bottom panel 110 along a back edge thereof, a front panel 130 extending upward from the bottom panel 110 along a front edge thereof, and a pair of bottom side flaps 112 extending from opposite sides of the bottom panel 110. The back panel 120 and the front panel 130 are each preferably oriented generally perpendicular to the bottom panel 110. The bottom side flaps 112 extend upward from the bottom panel 110 and are also preferably oriented generally perpendicular to the bottom panel 110. As such, the tray 100 is generally L-shaped.

Figure 6:
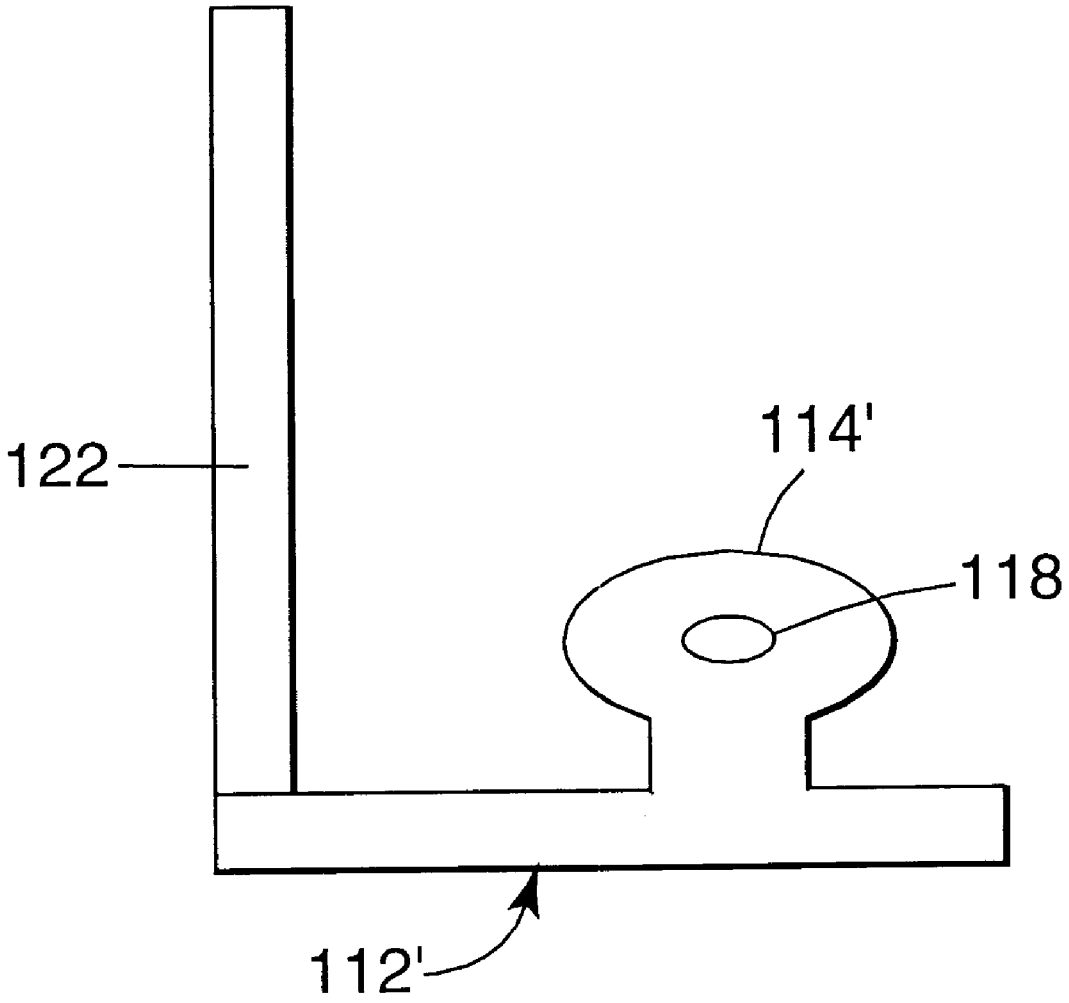
FIG. 6 is a side view of an alternative embodiment container according to the present invention.

As shown in FIG. 5, an upper edge 114 of the respective bottom side flaps 112 is preferably linear, extending generally parallel with a lower edge 116, such that the bottom side flaps 112 are relatively uniform in height. Alternatively, however, the upper edge 114 can assume other configurations, either linear or non-linear, such that the bottom side flaps 112 can have shapes, either regular or irregular, other than that shown in FIG. 5. For example, FIG. 6 depicts a side view of an alternative bottom side flap 112', in which an upper edge 114' is irregularly shaped. With this configuration, the bottom side flap 112' has a handle-like shape and includes an access hole 118. Preferably, however, the bottom side flaps 112 each have a height less than a height of the back panel 120.

The tray 100 also includes a pair of back side flaps 122 extending from opposite sides of the back panel 120 and a pair of front side flaps 132 extending from opposite sides of the front panel 130. The back side flaps 122 extend forward from the back panel 120 and are preferably oriented generally perpendicular to the back panel 120. The front side flaps 132 extend rearward from the front panel 130 and are preferably oriented generally perpendicular to the front panel 130. As such, each of the bottom side flaps 112 are secured to an adjacent one of the back side flaps 122 and the front side flaps 132. The bottom side flaps 112 can be secured to the back side flaps 122 and the front side flaps 132 by, for example, adhesive, tape, or staples.

The front panel 130 includes a back face (not shown) facing toward the back panel 120 and a front face 134 facing away from the back panel 120 opposite the back face. As shown in FIG. 5, the front face 134 provides a display area adapted to receive indicia 136 thereon. The indicia 136 generally includes information identifying the packaged products P positioned on the tray 100 and can be, for example, print printed directly on the front face 134 or a label affixed to the front face 134.

Also as shown in FIG. 5, the cover 200 includes a top panel 210 and a front panel 220 extending downward from the top panel 210 along a front edge thereof. The front panel 220 is preferably oriented generally perpendicular to the top panel 210. As such, the cover 200 is also generally L-shaped.

The cover 200 also includes a pair of top side flaps 212 extending from opposite sides of the top panel 210, a back flap 214 extending from a back edge of the top panel 210, and a pair of front side flaps 222 extending from opposite sides of the front panel 220. The top side flaps 212 extend downward from the top panel 210 and are preferably oriented generally perpendicular to the top panel 210. The back flap 214 is configured to extend generally downward from the top panel 210 and is pivotable relative to the top panel 210 about the back edge thereof. The front side flaps 222 extend rearward from the front panel 220 and are preferably oriented generally perpendicular to the front panel 220. As such, each of the top side flaps 212 are secured to an adjacent one of the front side flaps 222 by, for example, adhesive, tape, or staples.

Figure 7:
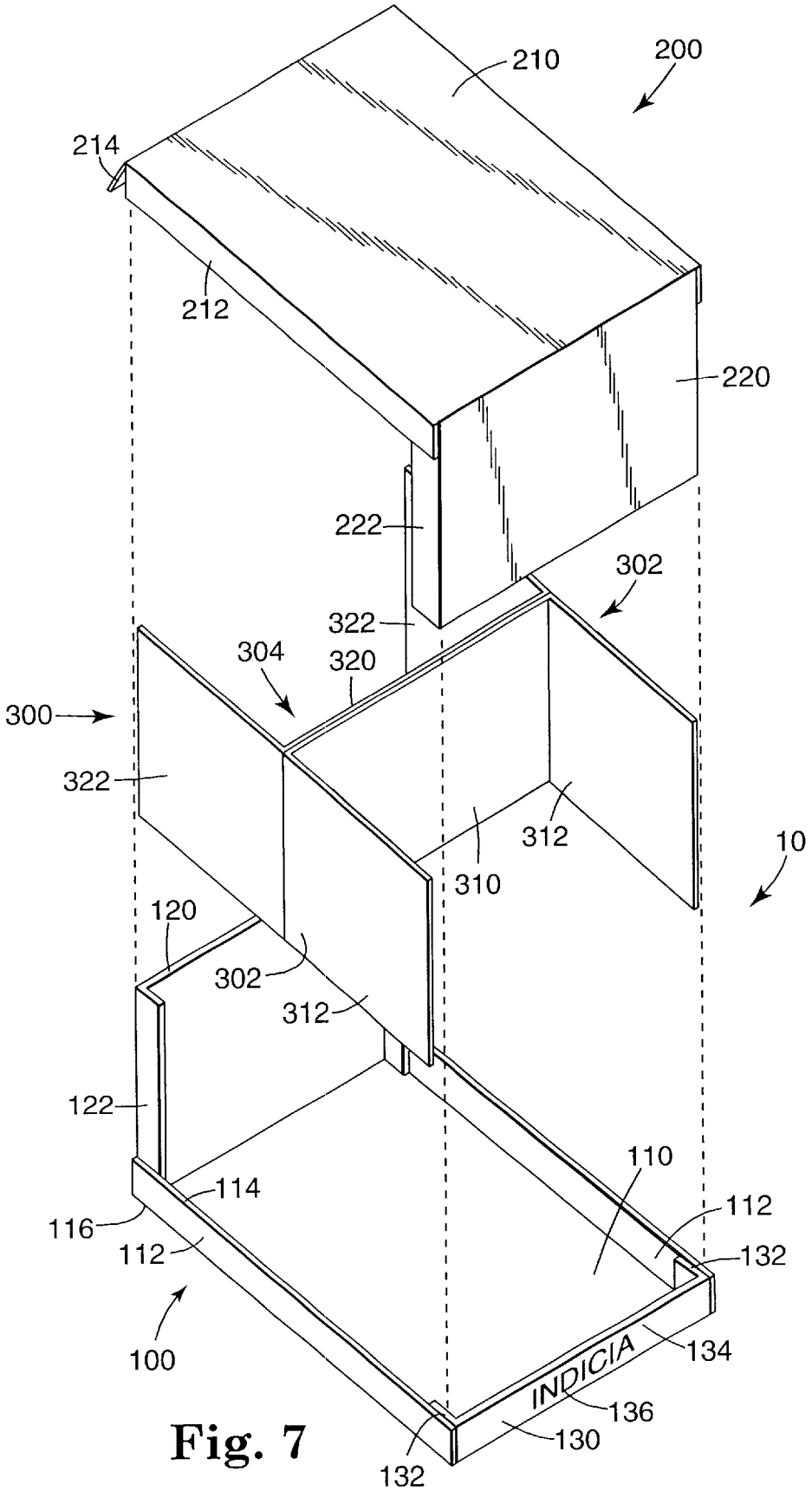
FIG. 7 is an exploded front persepective view of an alternate embodiment of a shipping and display container according to the present invention including an interior support member.

An alternate embodiment of the shipping and display container 10 is shown in FIG. 7. In this embodiment, the shipping and display container 10 includes the tray 100 and the cover 200 (both as previously described), and an interior support member 300. As shown in FIG. 7, the interior support member 300 includes a pair of spaced side panels 302 and an inner panel 304 extending between the side panels 302. The inner panel 304 is preferably oriented generally perpendicular to and generally bisects each of the side panels 302. Accordingly, the interior support member 300 is positionable on the tray 100 to provide additional support to the shipping and display container 10 when in the shipping and storage configuration. Furthermore, the interior support member 300 is removable from the tray 100 to permit unobstructed viewing of the packaged products P when the shipping and display container 10 is in the support and display configuration.

In one preferred embodiment, the interior support member 300 includes a first inner panel 310 having a pair of first side flaps 312 extending therefrom and a second inner panel 320 having a pair of second side flaps 322 extending therefrom. The first side flaps 312 extend from opposite sides of the first inner panel 310 and are preferably orientated generally perpendicular to the first inner panel 310. The second side flaps 322 extend from opposite sides of the second inner panel 320 and are preferably oriented generally perpendicular to the second inner panel 320. The first inner panel 310 and the second inner panel 320 are preferably joined along a top edge thereof.

Figure 8:
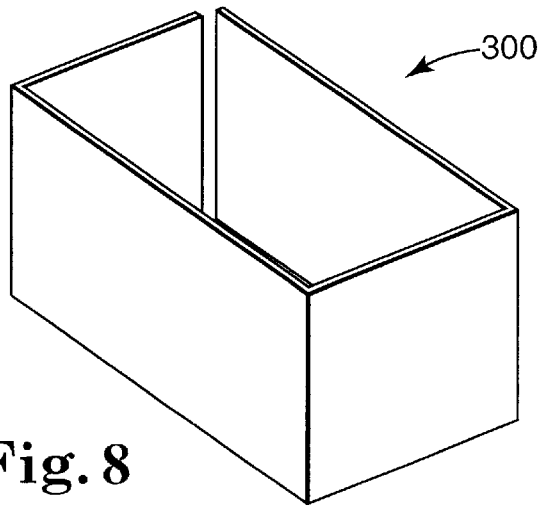
FIG. 8 is a perspective view of an alternative interior support member according to the present invention.

The interior support member 300 has been described and depicted as preferably being an H-shaped divider. Alternatively, the interior support member 300 can assume another partition/divider configurations. The interior support member 300 can be tube-shaped, as shown in FIG. 8.

The tray 100 and the cover 200 can be sized to accommodate a variety of different quantities, sizes, types, and configurations of packaged products P, especially packaged food products, such as cereals, snack foods, dried fruit products, etc. In addition, the packaged products P can be packaged as individual, relatively rigid boxes or cartons or individual bags or soft-side packages. When the packaged products P are packaged as individual bags or soft-side packages, for example, the interior support member 300 can be used to provide additional support and stability for the shipping and display container 10 as well as additional protection for the packaged products P by closing the partially opened opposite sides 14 of the shipping and display container 10 when in the shipping and storage configuration.

Figure 9:
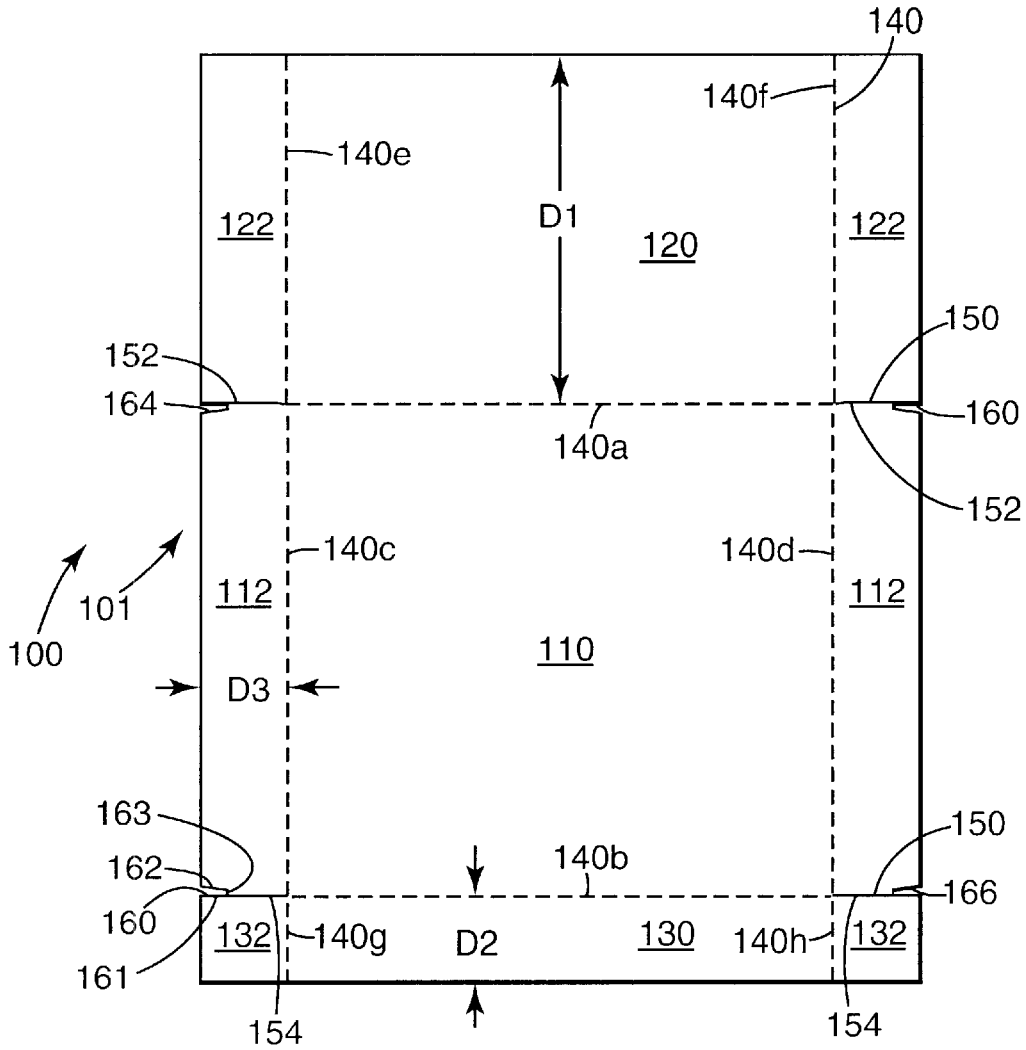
FIG. 9 is a plan view of a blank for forming a tray of a shipping and display container according to the present invention.
Figure 10:
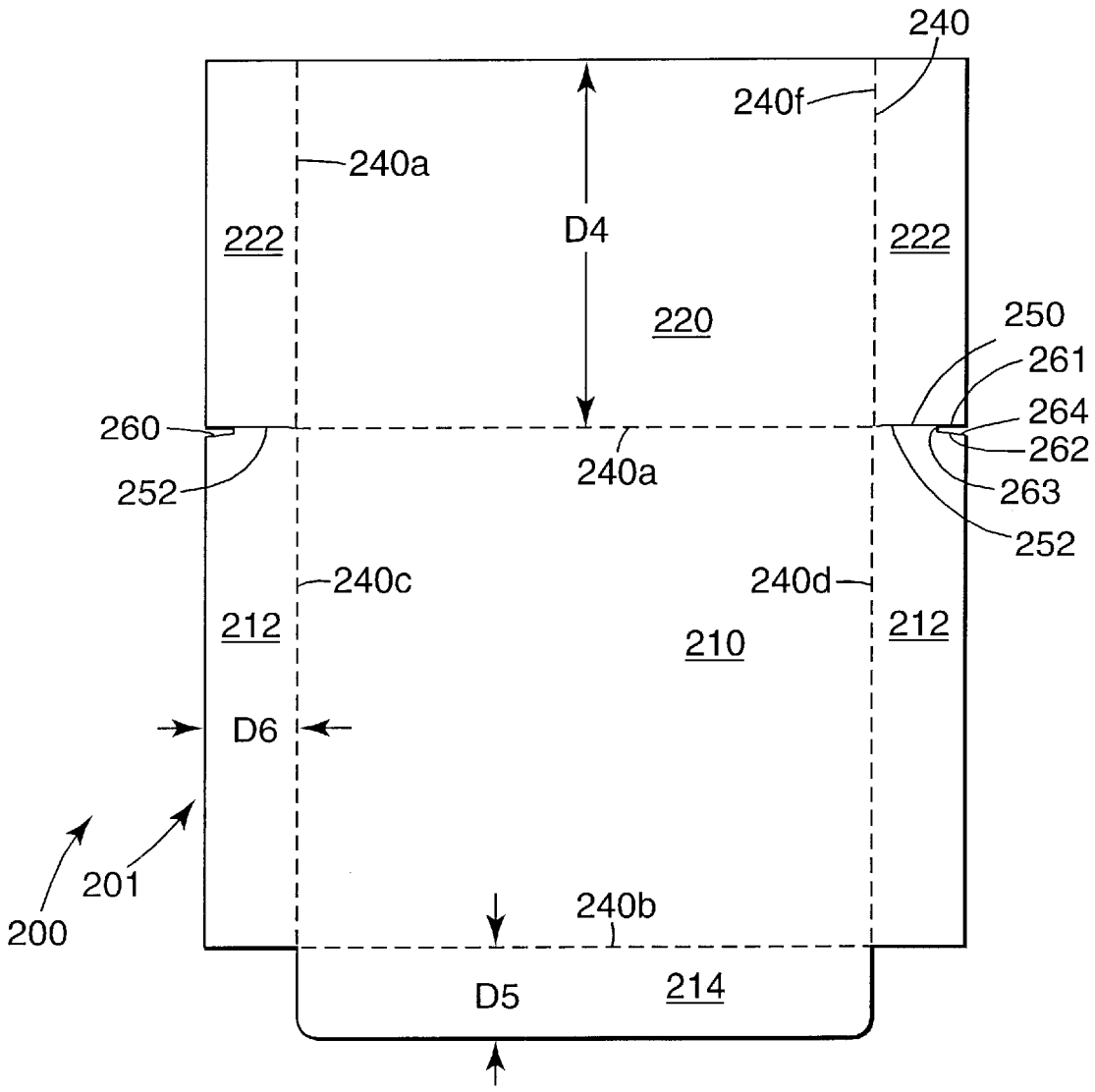
FIG. 10 is a plan view of a blank for forming a cover of a shipping and display container according to the present invention.
Figure 11:
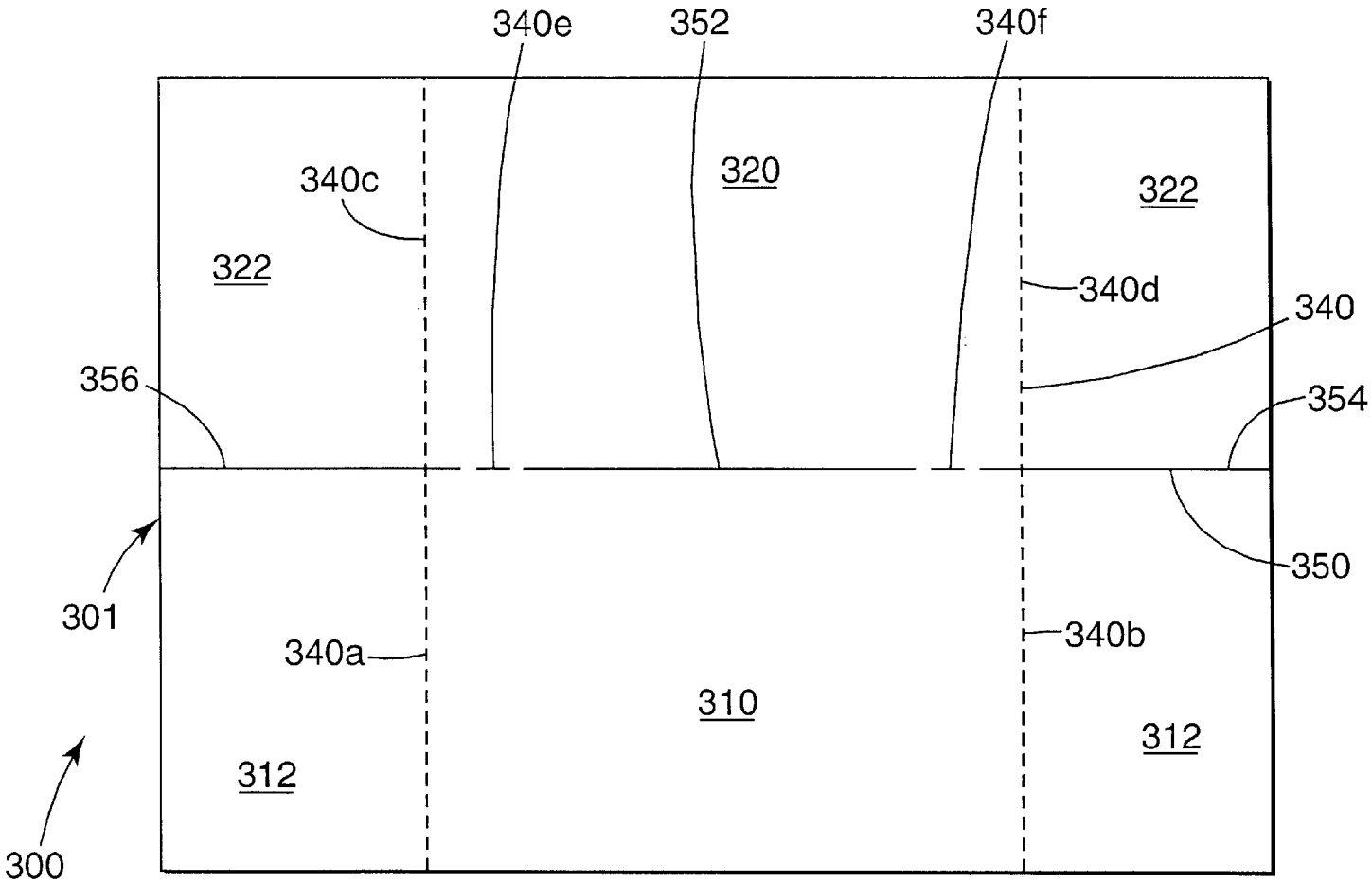
FIG. 11 is a plan view of a blank for forming an interior support member of a shipping and display container according to the present invention.

In FIGS. 9, 10, and 11, blanks 101, 201, and 301 for forming the tray 100, the cover 200, and the interior support member 300 of the alternate embodiment, respectively, of the shipping and display container 10 are shown. Each of the blanks 101, 201, and 301 is preferably formed from fiberboard, and more particularly, corrugated cardboard. A preferred direction of corrugation orientation is shown in the figures. It is, however, within the scope of the present invention to use single ply material, depending on the weight of the packaged products P to be loaded within the shipping and display container 10. Each of the blanks 101, 201, and 301 is preferably die-cut from a sheet of material with solid lines 150, 160; 250, 260; and 350, respectively, representing cut lines and dashed lines 140, 240, and 340, respectively, representing fold lines. Each of the fold lines, also referred to as scores or scorelines, are formed by impressions or creases made in the material to help position and facilitate folds.

As shown in FIG. 9, the blank 101 for forming the tray 100 includes the bottom panel 110, the back panel 120 which is integral with and adjacent to the bottom panel 110 along the back edge thereof, and the front panel 130 which is integral with and adjacent to the bottom panel 110 along the front edge thereof. Fold lines 140, slits 150, and slots 160 are provided to facilitate bending and folding of the back panel 120, the back side flaps 122, the front panel 130, the side flaps 132, and the bottom side flaps 112, relative to each other.

A back fold line 140*a* is formed between the back panel 120 and the bottom panel 110 along the back edge of the bottom panel 110 and a front fold line 140*b* is formed between the front panel 130 and the bottom panel 110 along the front edge of the bottom panel 110. The bottom side flaps 112 are integral with and extend outward from opposite side edges of the bottom panel 110 wherein a bottom side fold line 140*c* is formed between one of the bottom side flaps 112 and the bottom panel 110 along one side edge thereof and a bottom side fold line 140*d* is formed between another of the bottom side flaps 112 and the bottom panel 110 along an opposite side edge thereof. In addition, the back side flaps 122 are integral with and extend outward from opposite side edges of the back panel 120 wherein a back side fold line 140*e* is formed between one of the back side flaps 122 and the back panel 120 along one side edge thereof and a back side fold line 140*f* is formed between another of the back side flaps 122 and the back panel 120 along an opposite side edge thereof. Furthermore, the front side flaps 132 are integral with and extend outward from opposite side edges of the front panel 130 wherein a front side fold line 140*g* is formed between one of the front side flaps 132 and the front panel 130 along one side edge thereof and a front side fold line 140*h* is formed between another of the front side flaps 122 and the front panel 130 along an opposite side edge thereof.

The slits 150 include a pair of back slits 152 each formed between one of the back side flaps 122 and one of the bottom side flaps 112, and a pair of front slits 154 each formed between one of the front side flaps 132 and one of the bottom side flaps 112. The slots 160 include a pair of back slots 164 each formed between one of the back side flaps 122 and one of the bottom side flaps 112, and a pair of front slots 166 each formed between one of the front side flaps 132 and one of the bottom side flaps 112. Each of the slots 160 is formed by a first cut 161, a second cut 162 spaced from the first cut 161, and a third cut 163 extending between the first cut 161 and the second cut 162.

In one preferred embodiment, a portion of the slits 150 constitutes the first cut 161. Having a portion of the slits 150 constitute the first cut 161 produces stable and sturdy corners when the back panel 120, the back side flaps 122, the front panel 130, the front side flaps 132, and the bottom side flaps 112 are bent and folded, relative to each other. As such, each of the slots 160 is defined by the first cut 161 which is formed by a portion of one of the slits 150, the second cut 162 which is formed in the bottom side flaps 112, and the third cut 163 which is also formed in the bottom side flaps 112. Accordingly, opposite side edges of the bottom side flaps 112 are aligned with the front panel 130 and the back panel 120, respectively, when the tray 100 is formed from the blank 101 by folding along the fold lines 140 and securing the adjacent side flaps together. Aligning the opposite side edges of the bottom side flaps 112 with the front panel 130 and the back panel 120, respectively, provides increased longitudinal and transverse support for the tray 100.

As shown in FIG. 9, the back panel 120 has a dimension D1 extending perpendicular to the back edge of the bottom panel 110 and the front panel 130 has a dimension D2 extending perpendicular to the front edge of the bottom panel 110. In addition, each of the bottom side flaps 112 have a dimension D3 extending perpendicular to the side edges of the bottom panel 110. In one preferred embodiment, the dimension D2 of the front panel 130 is equal to the dimension D3 of the bottom side flaps 112 (D2=D3) and the dimension D1 of the back panel 120 is greater than both the dimension D2 of the front panel 130 and the dimension D3 of the bottom side flaps 112 (D1>D2 and D1>D3). In addition, the back slits 152 are offset from the back fold line 140*a* and the front slits 154 are offset from the front fold line 140*b*. Furthermore, the bottom side fold line 140*c* is offset from both the back side fold line 140*e* and the front side fold line 140*g*, and the bottom side fold line 140*d* is offset from both the back side fold line 140*f* and the front side fold line 140*h*.

As shown in FIG. 10, the blank 201 for forming the cover 200 includes the top panel 210 and the front panel 220 which is integral with and adjacent to the top panel 210 along the front edge thereof. In addition, the back flap 214 is integral with and extends outward from the top panel 210 along the back edge thereof. Fold lines 240, slits 250, and slots 260 are provided to facilitate bending and folding of the front panel 220, the front side flaps 222, the top side flaps 212, and the back flap 214, relative to each other.

A front fold line 240*a* is formed between the front panel 220 and the top panel 210 along the front edge of the top panel 210 and a back fold line 240*b* is formed between the back flap 214 and the top panel 210 along the back edge of the top panel 210. The top side flaps 212 are integral with and extend outward from opposite side edges of the top panel 210 wherein a top side fold line 240*c* is formed between one of the top side flaps 212 and the top panel 210 along one side edge thereof and a top side fold line 240*d* is formed between another of the top side flaps 212 and the top panel 210 along an opposite side edge thereof. In addition, the front side flaps 222 are integral with and extend outward from opposite side edges of the front panel 220 wherein a front side fold line 240*e* is formed between one of the front side flaps 222 and the front panel 220 along one side edge thereof and a front side fold line 240*f* is formed between another of the front side flaps 222 and the front panel 220 along an opposite side edge thereof.

The slits 250 include a pair of front slits 252 each formed between one of the front side flaps 222 and one of the top side flaps 212. The slots 260 include a pair of front slots 264 each formed between one of the front side flaps 222 and one of the top side flaps 212. Each of the slots 260 is formed by a first cut 261, a second cut 262 spaced from the first cut 261, and a third cut 263 extending between the first cut 261 and the second cut 262.

In one preferred embodiment, a portion of the slits 250 constitutes the first cut 261. Having a portion of the slits 250 constitute the first cut 261 produces stable and sturdy corners when the front panel 220, the front side flaps 222, and the top side flaps 212 are bent and folded, relative to each other. As such, each of the slots 260 is defined by the first cut 261 which is formed by a portion of one of the slits 250, the second cut 262 which is formed in the top side flaps 212, and the third cut 263 which is also formed in the top side flaps 212. Accordingly, one side edge of each of the top side flaps 212 is aligned with the front panel 220 when the cover 200 is formed from the blank 201 by folding along the fold lines 240 and securing the adjacent side flaps together. Aligning the side edge of each of the top side flaps 212 with the front panel 220 provides increased longitudinal and transverse support for the cover 200.

As shown in FIG. 10, the front panel 220 has a dimension D4 extending perpendicular to the front edge of the top panel 210 and the back flap 214 has a dimension D5 extending perpendicular to the back edge of the top panel 210. In addition, each of the top side flaps 212 have a dimension D6 extending perpendicular to the side edges of the top panel 210. In one preferred embodiment, the dimension D4 of the front panel 220 is greater than both the dimension D5 of the back flap 214 and the dimension D6 of the top side flaps 212 (D4>D5 and D4>D6). In addition, the front slits 252 are offset from the front fold line 240*a*.

As shown in FIG. 11, the blank 301 for forming the interior support member 300 of the alternate embodiment includes the first inner panel 310 and the second inner panel 320 which is integral with and adjacent to the first inner panel 310. Fold lines 340 and slits 350 are provided to facilitate bending and folding of the first inner panel 310, the first side flaps 312, the second inner panel 320, and the second side flaps 322 relative to each other. First side flaps 312 are integral with and extend outward from opposite side edges of the inner panel 310 wherein a fold line 340*a* is formed between one of the first side flaps 312 and the first inner panel 310 along one side edge thereof and a fold line 340*b* is formed between another of the first side flaps 312 and the first inner panel 310 along an opposite side edge thereof. Second side flaps 322 are integral with and extend outward from opposite side edges of the second inner panel 320 wherein a fold line 340*c* is formed between one of the second side flaps 322 and the second inner panel 320 along one side edge thereof and a fold line 340*d* is formed between another of the second side flaps 322 and the second inner panel 320 along an opposite side edge thereof. Slit 352 is formed between the first inner panel 310 and the second inner panel 320 and fold lines 340*e* and 340*f* are formed at opposite ends of the slit 352 between the first inner panel 310 and the second inner panel 320. In addition, slits 354 and 356 are formed between the first side flaps 312 and the second side flaps 322.

In use, the tray 100, the cover 200, and the interior support member 300 of the alternate embodiment are formed from the blanks 101, 201, and 301, respectively, by folding along the fold lines 140, 240, and 340, respectively, and securing the adjacent side flaps together, as previously described. Thereafter, the packaged products P are positioned on the tray 100. If additional support or protection is desired, the interior support member 300 is positioned on the tray 100 either before or after the packaged products P are positioned on the tray 100. Next, the cover 200 is positioned over the tray 100 and the packaged products P. Thereafter, each of the front side flaps 222 of the cover 200 are releasably secured to an adjacent one the bottom side flaps 112 of the tray 100 and the back flap 214 of the cover 200 is releasably secured to the back panel 120 of the tray 100 by, for example, adhesive, tape, or staples. As such, the shipping and storage configuration of the shipping and display container 10, as shown in FIGS. 3A and 3B, is established. Accordingly, the shipping and display container 10, loaded with the packaged products P, can be transported or shipped to a desired location and stored in a convenient manner, such as stacking.

In the shipping and storage configuration, the interior support member 300, if used, provides additional support and stability for the shipping and display container 10. This additional support and stability permits increased stacking height in a storage location. In a warehouse, for example, multiple shipping and display containers 10 can be safely stacked upon each other thereby occupying less space and thus reducing distribution costs. In addition, the side panels 302 of the interior support member 300 provide additional protection for the packaged products P by closing the partially opened opposite sides 14 created by the tray 100 and the cover 200 when the shipping and display container 10 is in the shipping and storage configuration. Furthermore, in the shipping and storage configuration, the front panel 220 of the cover 200 covers the front panel 130 of the tray 100. The front panel 220, therefore, protects the indicia 136 from being marred or damaged during shipping and storage of the shipping and display container 10.

To display the packaged products P, the back flap 214 is released from the back panel 120 and the front side flaps 222 are released from the bottom side flaps 112. Next, the cover 200 is removed from the tray 100. As such, the support and display configuration of the shipping and display container 10, as shown in FIGS. 4A and 4B, is established. Thereafter, the tray 100, including the packaged products P, can be conveniently positioned in a display location, for example, on a shelf or stand. Accordingly, the packaged products P are easily displayed in an appealing and attractive upright manner which permits unobstructed viewing of the packaged products P by a consumer. In addition, the back panel 120, the back side flaps 122, the bottom side flaps 112, and the front panel 130 provide vertical and lateral support for the packaged products P when positioned on the tray 100. For example, if the packaged products P are packaged as individual bags or soft-side packages, the panels and flaps support the packaged products P in an upright display position.

In one preferred embodiment, adhesive, such as hot melt adhesive, and more specifically, UltraMount adhesive, is used to releasably secure each of the front side flaps 222 of the cover 200 to an adjacent one the bottom side flaps 112 of the tray 100, and to releasably secure the back flap 214 of the cover 200 to the back panel 120 of the tray 100. Preferably, a generally concentrated area of adhesive is provided between an interior surface of a lower portion of each of the front side flaps 222 of the cover 200 and an exterior surface of a front portion of an adjacent one the bottom side flaps 112 of the tray 100, and generally spaced concentrations of adhesive are provided between an interior surface of the back flap 214 of the cover 200 and an exterior surface of an upper portion of the back panel 120 of the tray 100. As such, a handler of the shipping and display container 10 can conveniently and easily release the back flap 214 from the back panel 120 and the front side flaps 222 from the bottom side flaps 112. The handler, for example, can insert his or her hand between the back flap 214 and the back panel 120 and pull up and out on the back flap 214 to release the back flap 214 from the back panel 120 and then continue to pull the cover 200 up and forward to release the front side flaps 222 from the bottom side flaps 112. Using adhesive to secure the cover 200 to the tray 100, therefore, permits convenient and easy opening of the shipping and display container 10 without a knife or sharp implement, thus eliminating the potential for possibly cutting the packaged products P.

The shipping and display container 10 provides a single container which facilitates shipping and storage of several individually packaged products as well as support and display of the packaged products for consumer purchase. In doing so, the shipping and display container 10 provides improved protection for the packaged products throughout distribution and enhances display of the packaged products in a sales environment. Furthermore, the shipping and display container 10 does so while utilizing less material than current containers, thereby reducing material cost.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention.

What is claimed is:

1. A shipping and display container, comprising:

a tray including a tray bottom panel, a tray back panel, and a tray front panel, the tray back panel extending upward from the tray bottom panel along a back edge thereof, the tray front panel extending upward from the tray bottom panel along a front edge thereof, the tray including a pair of bottom side flaps each extending upward from the tray bottom panel along opposite side edges thereof, the tray back panel extending upward beyond the tray front panel and the bottom side flaps; and a cover positionable over the tray in a storage configuration and removable from the tray in a display configuration, the cover including a cover top panel, a cover front panel extending downward from the cover top panel along a front edge thereof, and a top back flap configured to extend generally downward from the cover top panel along a back edge therof and pivot relative to the cover top panel about the back edge thereof, wherein the cover is configured such that in the storage configuration the cover front panel covers at least a portion of the tray front panel.

2. The shipping and display container of claim 1, wherein the tray includes a pair of front side flaps each extending rearward from the tray front panel along opposite side edges thereof, each of the bottom side flaps being secured to an adjacent one of the front side flaps.

3. The shipping and display container of claim 1, wherein the tray includes a pair of back side flaps each extending forward from the tray back panel along opposite side edges thereof, each of the bottom side flaps being secured to an adjacent one of the back side flaps.

4. The shipping and display container of claim 1, wherein the tray front panel includes a back surface facing the back panel and a front surface opposite the back surface, the front surface forming a display panel adapted to receive indicia thereon.

5. The shipping and display container of claim 1, wherein the top back flap is secured to the tray back panel by an adhesive in the storage configuration.

6. The shipping and display container of claim 5, wherein the adhesive includes at least two spaced applications of adhesive.

7. The shipping and display container of claim 1, wherein the cover front panel extends downward beyond the top back flap.

8. The shipping and display container of claim 1, wherein the cover includes a pair of top side flaps each extending downward from the cover top panel along opposite side edges thereof.

9. The shipping and display container of claim 8, wherein the cover includes a pair of front side flaps each extending rearward from the cover front panel along opposite side edges thereof, each of the top side flaps being secured to an adjacent one of the front side flaps.

10. The shipping and display container of claim 1, wherein the cover includes a pair of front side flaps each extending rearward from the cover front panel along opposite side edges thereof.

11. The shipping and display container of claim 10, wherein the front side flaps extend over the bottom side flaps in the storage configuration and are secured to the bottom side flaps by an adhesive in the storage configuration.

12. The shipping and display container of claim 1, wherein the cover front panel covers the tray front panel in the storage configuration.

13. The shipping and display container of claim 10, wherein the top back flap of the cover is releasably secured to the tray back panel and each of the front side flaps of the cover are releasably secured to an adjacent one of the bottom side flaps of the tray in the storage configuration.

14. The shipping and display container of claim 1, further comprising:

an interior support member including a pair of spaced side panels and an inner panel extending between the spaced side panels, the interior support member being positionable on and removable from the tray.

15. A packaged good article, comprising:

a shipping and display container comprising:

a tray including a tray bottom panel, a tray back panel, and a tray front panel, the tray back panel extending upward from the tray bottom panel along a back edge thereof, the tray front panel extending upward from the tray bottom panel along a front edge thereof, the tray including a pair of bottom side flaps each extending upward from the tray bottom panel along opposite side edges thereof, the tray back panel extending upward beyond the tray front panel and the bottom side flaps, and a cover positionable over the tray in a storage configuration and removable from the tray in a display configuration, the cover including a cover top panel, a cover front panel extending downward from the cover top panel along a front edge thereof, and a top back flap configured to extend generally downward from the cover top panel along a back edge thereof and pivot relative to the cover top panel about the back edge thereof, wherein the cover is configured such that in the storage configuration the cover front panel covers at least a portion of the tray front panel; and a plurality of packaged products positioned on the tray of the shipping and display container.

16. The packaged good article of claim 15, wherein the tray includes a pair of front side flaps each extending rearward from the tray front panel along opposite side edges thereof, each of the bottom side flaps being secured to an adjacent one of the front side flaps.

17. The packaged good article of claim 15, wherein the tray includes a pair of back side flaps each extending forward from the tray back panel along opposite side edges thereof, each of the bottom side flaps being secured to an adjacent one of the back side flaps.

18. The packaged good article of claim 15, wherein the tray front panel includes a back surface facing the back panel and a front surface opposite the back surface, the front surface forming a display panel adapted to receive indicia thereon.

19. The packaged good article of claim 15, wherein the top back flap is secured to the tray back panel by an adhesive in the storage configuration.

20. The packaged good article of claim 19, wherein the adhesive includes at least two spaced applications of adhesive.

21. The packaged good article of claim 15, wherein the cover front panel extends downward beyond the top back flap.

22. The packaged good article of claim 15, wherein the cover includes a pair of top side flaps each extending downward from the cover top panel along opposite side edges thereof.

23. The packaged good article of claim 22, wherein the cover includes a pair of front side flaps each extending rearward from the cover front panel along opposite side edges thereof, each of the top side flaps being secured to an adjacent one of the front side flaps.

24. The packaged good article of claim 15, wherein the cover front panel covers the tray front panel in the storage configuration.

25. The packaged good article of claim 15, wherein the cover includes a pair of front side flaps each extending rearward from the cover front panel along opposite side edges thereof.

26. The packaged good article of claim 25, wherein the front side flaps extend over the bottom side flaps in the storage configuration and are secured to the bottom side flaps by an adhesive in the storage configuration.

27. The packaged good article of claim 25, wherein the top back flap of the cover is releasably secured to the tray back panel and each of the front side flaps of the cover are releasably secured to an adjacent one of the bottom side flaps of the tray in the storage configuration.

28. The packaged good article of claim 15, wherein the plurality of packaged products comprises a plurality of packaged food products.

29. The packaged good article of claim 28, wherein each of the plurality of packaged food products are packaged in individual boxes.

30. The packaged good article of claim 28, wherein each of the plurality of packaged food products are packaged in individual bags.

31. The packaged good article of claim 15, further comprising:

an interior support member including a pair of spaced side panels and an inner panel extending between the spaced side panels, the interior support member being positionable on and removable from the tray.

32. A blank for forming a tray of a shipping and display container, the blank comprising:

a bottom panel;

a back panel adjacent to the bottom panel along a back edge thereof, the back panel having a back panel dimension extending perpendicular to the back edge of the bottom panel;

a front panel adjacent to the bottom panel along a front edge thereof, the front panel having a front panel dimension extending perpendicular to the front edge of the bottom panel;

a pair of bottom side flaps each extending from opposite side edges of the bottom panel, each of the bottom side flaps having a bottom side flap dimension extending perpendicular to the side edges of the bottom panel, the back panel dimension being greater than both the front panel dimension and the bottom side flap dimension;

at least one pair of side flaps each extending from opposite side edges of one of the back panel and the front panel;

at least one pair of slits each formed between one of the side flaps and one of the bottom side flaps; and at least one pair of slots each formed between one of the side flaps and one of the bottom side flaps, each of the slots being defined by a first cut formed by a portion of one of the slits, and a second cut spaced from the first cut and formed in one of the bottom side flaps.

33. The blank of claim 32, wherein the at least one pair of side flaps includes a pair of back side flaps each extending from opposite side edges of the back panel and a pair of front side flaps each extending from opposite side edges of the front panel, and further comprising:

a pair of bottom side fold lines each formed between the bottom panel and one of the bottom side flaps along the side edges of the bottom panel;

a pair of back side fold lines each formed between the back panel and one of the back side flaps along the side edges of the back panel; and a pair of front side fold lines each formed between the front panel and one of the front side flaps along the side edges of the front panel, the bottom side fold lines being offset from both the back side fold lines and the front side fold lines.

34. The blank of claim 33, wherein the at least one pair of slits includes a pair of back slits each formed between one of the back side flaps and one of the bottom side flaps, and wherein the at least one pair of slots includes a pair of back slots each formed between one of the back side flaps and one of the bottom side flaps, each of the back slots being defined by a first back cut formed by a portion of one of the back slits, and a second back cut spaced from the first back cut and formed in one of the bottom side flaps.

35. The blank of claim 34, further comprising:

a back fold line formed between the back panel and the bottom panel along the back edge of the bottom panel, the back slits being offset from the back fold line.

36. The blank of claim 33, wherein the at least one pair of slits includes a pair of front slits each formed between one of the front side flaps and one of the bottom side flaps, and wherein the at least one pair of slots includes a pair of front slots each formed between one of the front side flaps and one of the bottom side flaps, each of the front slots being defined by a first front cut formed by a portion of one of the front slits, and a second front cut spaced from the first front cut and formed in one of the bottom side flaps.

37. The blank of claim 36, further comprising:

a front fold line formed between the front panel and the bottom panel along the front edge of the bottom panel, the front slits being offset from the front fold line.

38. The blank of claim 32, wherein the front panel dimension is substantially equal to the bottom side flap dimension.

* * * * *